US006423902B1

(12) United States Patent
Babiel et al.

(10) Patent No.: US 6,423,902 B1
(45) Date of Patent: Jul. 23, 2002

(54) ELECTRIC CABLE

(75) Inventors: Gerhard Babiel, Kamp-Lintfort; Günther Nölle, Lörrach; Franz-Josef Lietz, Oberhausen, all of (DE)

(73) Assignee: Auto Kabel Managementgesellschaft, Wiesental (DE)

( * ) Notice: Subject to any disclaimer, the term of this patent is extended or adjusted under 35 U.S.C. 154(b) by 0 days.

(21) Appl. No.: 09/623,804

(22) PCT Filed: Mar. 9, 1999

(86) PCT No.: PCT/EP99/01514

§ 371 (c)(1),
(2), (4) Date: Oct. 18, 2000

(87) PCT Pub. No.: WO99/46832

PCT Pub. Date: Sep. 16, 1999

(30) Foreign Application Priority Data

Mar. 12, 1998 (DE) ..... 198 10 662

(51) Int. Cl.[7] ..... H01R 4/00
(52) U.S. Cl. ..... 174/84 R; 174/88 R
(58) Field of Search ..... 174/74 R, 76, 174/77 R, 84 R, 88, 75 F

(56) References Cited

U.S. PATENT DOCUMENTS 1,390,607 A * 9/1921 Farmer
3,622,682 A * 11/1971 Buroni ..... 174/22 R
4,060,299 A * 11/1977 Williams ..... 339/48
4,163,134 A * 7/1979 Budrose ..... 200/157
4,307,369 A * 12/1981 Jackson, Jr. ..... 337/282
4,366,430 A * 12/1982 Wright ..... 320/25
4,562,454 A * 12/1985 Schultz et al. ..... 357/51
4,589,047 A * 5/1986 Gails et al. ..... 361/42
4,812,670 A * 3/1989 Goulet ..... 307/10.2
5,066,905 A 11/1991 Betton et al. ..... 324/133
5,606,148 A * 2/1997 Escherich et al. ..... 174/88 R
5,706,161 A * 1/1998 Adam ..... 361/124

FOREIGN PATENT DOCUMENTS

| | | |
|---|---|---|
| DE | 26 03 100 A1 | 8/1977 |
| DE | 40 06 866 C | 6/1991 |
| DE | 298 04 377 U1 | 7/1998 |
| JP | 06 013766 A | 1/1994 |

* cited by examiner

*Primary Examiner*—Dean A. Reichard
*Assistant Examiner*—William H. Mayo, III
(74) *Attorney, Agent, or Firm*—Proskauer Rose LLP

(57) ABSTRACT

An electrical cable for supplying power from a power source to a consumer unit has at least one interruption region in which a component for interrupting the current flow is arranged. The component is a controllable semiconductor element in particular a semiconductor chip, whose contact surfaces effective for the current flow, are in direct contact through pressure action, with the faces of the connection sections of the cable in the interruption region, such that as little dissipation heat as possible arises.

29 Claims, 2 Drawing Sheets

ELECTRIC CABLE

BACKGROUND OF THE INVENTION

1. Field of the Invention

The invention relates to an electrical cable for supplying power from a power source to a consumer unit, said cable comprising at least one interruption region in which a component for interrupting the power flow is arranged.

2. Description of Related Art

An electrical cable of this type is known from the German patent specification 40 06 866. This cable provides a conventional fuse element in the shape of a safety fuse in the interruption region, said safety fuse being surrounded by an electrically insulating housing. Together with two contact bodies with which the two ends of a fusible wire are conductively connected, there are two plug and socket connections for a plug connection each. Consequently the housing is configured as a sleeve for removable accommodation of a fuse cartridge. Such types of fuses are commonly used in motor vehicle construction.

To switch the current flow in current-carrying cables, in general, semiconductor components such as e.g. transistors, thyristors and similar are used, with the ends of the electrical cables being connected to said components. Due to the voltage drop present at a semiconductor switch even in the switched-through state, dissipation power results, which gives rise to dissipation heat. For this reason, in the case of high-current applications, the semiconductor component must be provided with a cooling device so as to carry away the dissipation heat. Such a semiconductor switch is known from DE-AS 1039645.

Power transistors are also known from the state of the art.

Usually, contacting in power transistors is by way of bond wires. The semiconductor chip comprises metallic surfaces to which a thin metallic bond wire is welded. This process of bonding causes problems above all in the case of very thin chips, for example chips with a thickness of less than 150 $\mu$m, so that there is a danger of the semiconductor being destroyed by thermomechanical tension.

It is thus the object of the invention to improve an electrical cable of the type mentioned in the introduction, to the extent that as little dissipation heat as possible arises.

This object is met in that the component is a controllable semiconductor component, in particular a semiconductor chip whose effective contact surfaces in the interruption region, are directly connected by the effect of pressure to the faces of the connection sections of the cable.

SUMMARY OF THE INVENTION

According to the solution provided by the invention, as a result of direct surface contact between the connection surfaces of the cable sections and the effective cross-sectional surface of the semiconductor component, the junction resistance is almost eliminated and accordingly, no dissipation heat arises in that location. Furthermore, the integration of the semiconductor component in the interruption region of the electrical cable makes possible a compact design characterized by particularly high stability due to the effect of the mutual pressure between the end sections of the cable and the semiconductor component.

The semiconductor component can for example be a power field effect transistor whose cathode is connected to one end of the cable, and whose anode is connected to the other cable. Furthermore, the semiconductor component can comprise a control electrode, for example a gate connection or a base connection, by way of which the semiconductor switch can be driven, and controlled or blocked more or less conductively.

According to a first preferred embodiment of the invention, the pressure exerted in the area of the semiconductor element can be generated, in that a housing is provided which encloses the interruption region of which there is at least one; said housing comprising pressure means, in particular pressure springs, for exerting pressure on the connection sections of the cable against the effective contact surfaces of the semiconductor element. The metallic housing itself can be configured as a pressure means, for example if it functions as a pressure spring. To produce such a component, before or during encasing of the housing, the connection areas which form the high-current contacts of the semiconductor element, which areas can in particular also be formed by compressed conductor ends, are pressed at a pressure exceeding 100 N/mm$^2$ onto the contact surfaces of the semiconductor chip. After encasing the housing, this pressure is held by the metallic housing.

In a further preferred embodiment, the metallic housing and/or the surfaces of the connection sections of the cable are coated so as to be at least partly electrically insulating, or the electrical insulation is formed by an insulating washer between the metallic housing and the high-current contact.

In an alternative to the housing enclosing the interruption region, the interruption region can also be surrounded by a plastic encapsulation, within which he exists pressure, particularly, thermally generated and/or reinforced pressure. The encapsulation can be formed by spraying, such that the pressure applied during the spraying process after cooling the sprayed material is frozen, and as a result of natural shrinkage during the cooling phase of the plastic, may be reinforced. Instead of plastic, a suitable ceramic material or a fiber-reinforced material can be used.

As an alternative, encapsulation can also take place by pouring-in the high-current contacts such that the pressure exerted before and during the hardening process is frozen after hardening of the material and is further reinforced by the natural shrinkage during hardening.

In a further alternative, pressure can be exerted by means of screwing down the high-current contacts such that a previously applied pressure in the area of the contact surfaces remains or is further reinforced by thermal influences.

An important aspect of the invention deals with the design of the control electrode of the semiconductor element (e.g. gate connection) of a power field effect transistor whose effective contact surface is connected to an electrical drive unit arranged in the interruption region.

According to a first variant, the means of contact can be a spring contact pin which in particular is arranged so as to be concentric with the ends of the cable connectors. This variant is particularly suitable where the high-current contacts of the main electrodes are formed by pressure contacts. Such main electrodes are formed by the drain/source connections in the case of field effect transistors; and by the collector/emitter connections in the case of power transformers.

As an alternative to the above, the means of contact of the control electrode is a passive radio receiver. It is arranged directly on the chip, in close proximity to the control electrode. In its simplest embodiment, the radio receiver comprises an aerial structure, a diode, and a coil which for example are etched in MOS technology. In a further embodiment, the receiver designed in this way may comprise several oscillating circuits with different resonance frequencies, for example to allow improved addressing of the receiver.

As an alternative to the above, the means of contact of the control electrode is provided by a sound pickup which for example works in the ultrasonic or hypersonic range. To this effect, a sound pickup is installed directly on the chip, in close proximity to the control electrode. In its simplest embodiment, said sound pickup is an aerial structure etched onto piezoelectric material. As an alternative to this, the receiver may comprise structures configured in the shape of an interdigital filter, thus making digital coding possible.

In a further alternative, the contact means is an optoelectronic receiver which is also arranged directly on the chip in close proximity to the control electrode. Said receiver comprises an optoelectronic semiconductor structure at whose outlet the gate control voltage is made available.

The spatial arrangement of the control electrode in relation to the remaining connections of the power semiconductor element is preferably selected such that it is centred. The edge arrangement of the control electrode is preferably circular or polygonal so that the highest possible current densities can be achieved.

BRIEF DESCRIPTION OF THE DRAWINGS

Below, the invention is described in more detail by means or one embodiment, as follows.

DETAILED DESCRIPTION OF THE INVENTION

Figure 1:
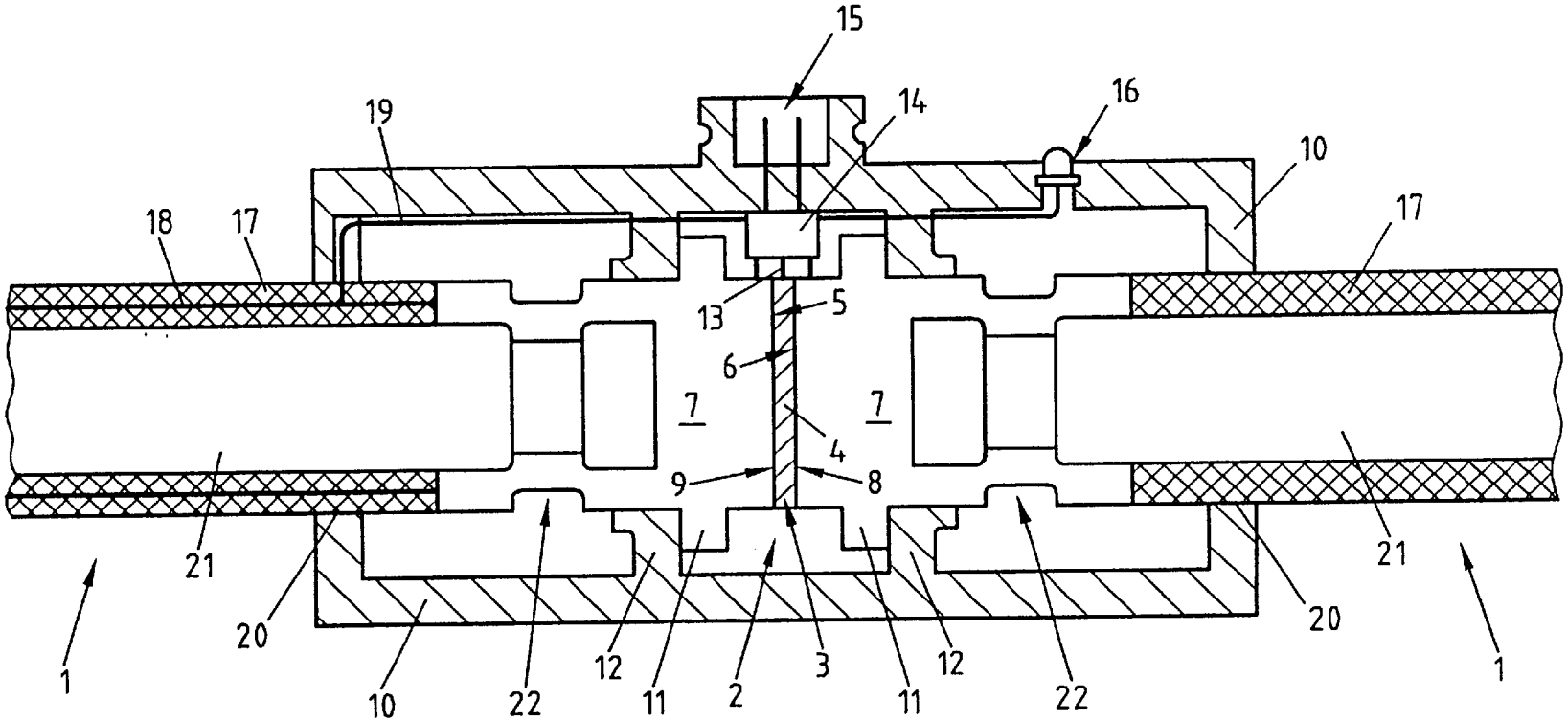
FIG. 1 is a sectional lateral view of an electrical cable comprising a semiconductor switch according to a by first embodiment of the invention arranged therein.

FIG. 1 shows an electrical cable 1 which is interrupted at a separation point 2 where it contacts a semiconductor switch 3. The semiconductor switch is inserted as a disk-shaped or plate-shaped semiconductor system 4 between the faces 5 and 6 of cable connectors 7. Advantageously, the diameter of the plate-shaped or tablet-shaped semiconductor system 4 is matched to the external diameter of the cable, thus resulting as far as possible in an axially constant cross-sectional shape of the cable with integrated semiconductor switch 3.

The semiconductor system 4 can be a field effect transistor made in MOSFET technology, with the option of the semiconductor system comprising several semiconductor elements switched parallel on a wafer; said semiconductor elements forming a semiconductor array. The special embodiment of the semiconductor system 4 can be configured according to the particular applications.

The use in conjunction with a high-current conductor is a preferred application, so that accordingly, the semiconductor system 4 too, must be designed according to the currents which occur.

By means of the semiconductor switch 3, the current flow in cable 1 can be controlled or interrupted. The semiconductor system 4 of the semiconductor switch 3 is integrated into the practically stretched course of cable 1, in that its flat surfaces 8 and 9 directly contact the faces 5 and 6 of the connection pieces 7. In the embodiment shown, the cable connection is made axially, but it can be made at any desired angle.

The present embodiment provides for pressure contacts, i.e. pressure is exerted on the connection pieces 7 towards the semiconductor system 4. This can take place via a housing 10 which bridges the separation point 2, with pressure means, e.g. pressure springs (not shown) being arranged if necessary in said housing 10 at the ends of the cables or the cable connectors 7. For example such pressure springs can be used between annular projections 11 at the connection pieces 7 and the inward protrusions of the housing.

If the semiconductor system 4 is a field effect transistor (with a larger number of individual semiconductor elements switched parallel to increase the current-carrying capacity,-being able to constitute the semiconductor system), then one flat surface 8 of the semiconductor system for example constitutes the anode connection and the other flat side 9 constitutes the cathode connection. A third connection at the semiconductor system 4 constitutes the gate connection 13 by way of which the semiconductor switch 3 can be controlled.

In the embodiment the semiconductor switch 3 is connected to an evaluation and control circuit 14 which is preferably constituted by an application-specific, integrated circuit. In this way, monitoring of the current flowing in the electrical cable via the semiconductor switch 3, can take place. Furthermore a current limit value can be monitored and current gradient monitoring can take place. This can take place depending on the application, thus providing the option of influencing the current flow within the cable, and if required, to interrupt said current flow. Advantageously, the evaluation and control circuit 14 can be connected via a BUS connection 15 to a central control device. Furthermore, the evaluation and control switch 14 is connected to an indicator device; in the embodiment shown this is a light emitting diode 16 by way of which a status display can take place, showing whether the semiconductor switch 3 is blocking or conducting current. For example, if the light is permanently on, this might signal that the semiconductor switch 3 has interrupted the current flow, while a blinking light emitting diode 16 might point to an internal defect.

The cable strand of the cable 1, shown on the left of FIG. 1, comprises a conductive protective coating 18 integrated in its insulation 17. Said protective layer is connected within the housing 10 via an electrical conductor 19 to the evaluation and control circuit 14. In this way, for example, when using the electrical cable with integrated semiconductor switch 3 as a high-current cable in a motor vehicle, it is possible to carry out crash monitoring across the entire sector. If during monitoring, the evaluation and control circuit detects a short-circuit between the conducting protective coating and the mass or an interruption of the protective coating 18, the semiconductor switch can be blocked by the evaluation and control circuit 14, thus interrupting the current flow, before the conductor of the cable itself establishes electrical contact with the mass which would result in a substantial current flow that might under certain circumstances cause a fire. Since the current flow in the cable itself is monitored too, and since interruption of the current flow by blocking the semiconductor switch takes place when the permissible current is exceeded, there is practically a double safeguard. The cable 1 can be a battery cable routed within the motor vehicle, along which cable one or several integrated semiconductor switches 3 with evaluation and control circuit and similar, are provided. There is the option of connecting the cable with an integrated semiconductor switch on one side of the semiconductor system to a battery terminal, while connecting the other side with consumer units, so that if required, electrical separation between the battery and the onboard electrical system is possible. Such electrical separation can be reversed again by driving the semiconductor switch.

As has already been mentioned above, for mechanical stabilization and for holding the cable ends, the housing 10 is provided, which in the embodiment shown is case-like in shape. It encloses the separation point 2 with the semiconductor system 4 located in-between, so that the parts located within the housing are accommodated so as to be protected from external influences. For the purpose of tension relief in axial direction, the inward protrusions 12 of the housing engage the annular projections 11 of the cable connection pieces 7 from behind, thus establishing a positive-locking connection. Housing lead-throughs 20, which are externally spaced apart from these positive-locking joints for retention in axial direction, support the two cable studs. FIG. 1 clearly shows that each of the cable ends or their conductors 21 is connected to a connection piece 7 via a crimp connection 22.

The evaluation and control circuit 14 as well as the light emitting diode 16 are also accommodated within the housing so as to be protected.

Figure 2:
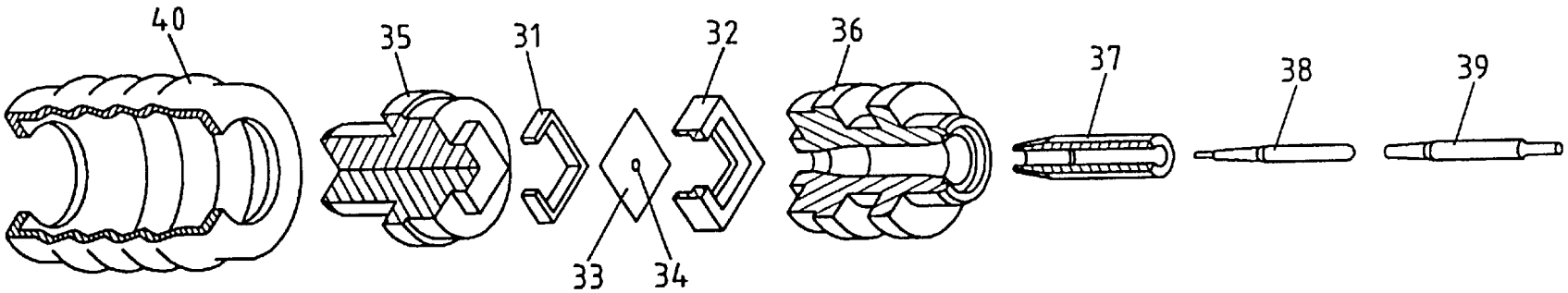
FIG. 2 is an exploded view of a further embodiment of an electrical cable according to the invention.
Figure 3:
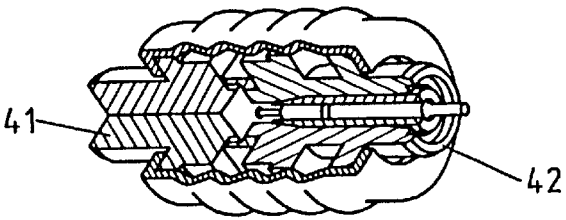
FIG. 3 shows the installed state of the embodiment according to FIG. 2.

FIG. 2 shows an exploded view of a second embodiment of a power supply cable according to the invention. FIG. 3 shows the assembled state of the individual components shown in FIG. 2.

Apart from the electrodes (not shown in detail) responsible for supplying power, the semiconductor component in the shape of a silicon chip 33, held and positioned by the position frame (31 or 32), comprises a gate connection 34. It is arranged centrally at the front of the silicon chip 33.

A first pressure piston 35 is arranged on the one power-carrying electrode of the silicon chip 33, said pressure piston comprising a square stamped part which establishes contact over its entire surface with the silicon chip 33.

The other pressure piston 36 establishes contact over its entire surface with the other electrode of the silicon chip, but it comprises a central recess in the middle. This recess makes it possible for a contact pin 38 located in that position and arranged in an insulation sleeve 37, to access the gate electrode 34 in the shape of a pointed contact. Contacting by the contact pin 38 takes place via a position sleeve 39. Electrical driving of the gate electrode 34 and thus opening or closing of the semiconductor element for the electrical current flow takes place via the contact pin 38.

The pressure pistons 35, 36 establish mutual pressure contact via a spring sleeve 40 so that the silicon chip 33 is enclosed between them, with electrical contact being maintained by pressure. On one side of the pressure piston 35 the battery terminal connection 41 is shaped, or the line connection if the cable is built into the line. The other line connection 42 is on the opposite side, at the further pressure piston 36.

According to further embodiments, not shown in the drawings, non-contacting elements can be provided instead of the contact pin for driving the gate electrode 34.

A first example is the driving of the gate electrode 34 by a passive radio receiver which is installed on the chip in close proximity to the gate electrode 34. In the simplest case this passive radio receiver comprises an aerial and a coil. When the correspondingly tuned signal is received, an electrical voltage is applied to the gate electrode so that control of the semiconductor element results.

As an alternative to this, a sound-sensitive element can be arranged in close proximity to the gate electrode 34. During excitation with a specified ultrasound frequency, said sound-sensitive element issues an electrical voltage to control the gate electrode. Such elements are for example known from practical applications as interdigital filters. A third variant consists of contacting of the control electrode taking place via an optoelectronic receiver which is also arranged in close proximity to the gate electrode 34.

What is claimed is:

1. An electrical cable for supplying power from a power source to a consumer unit, comprising:

at least one interruption region delimited from connection sections (7) of the at least one cable (1), the interruption region comprising a component for interrupting the current flow, wherein the component is a controllable semiconductor element (3), the semiconductor element comprising contact surfaces (8, 9) which allow current flow, the contact surfaces being in direct contact through pressure action with faces of the connection sections (7).

2. The electrical cable according to claim 1, wherein the semiconductor element is a semiconductor chip.

3. The electrical cable according to claim 1, wherein a housing (10) is provided to enclose the at least one interruption region, the housing comprising pressure means for exerting pressure on the connection sections (7) of the cable (1) against the contact surfaces (8, 9) of the semiconductor element (3).

4. The electrical cable according to claim 3, wherein the pressure means are pressure springs.

5. The electrical cable according to claim 3, wherein the housing is constructed of metal.

6. The electrical cable according to claim 3, wherein the housing is configured as a pressure-generating means.

7. The electrical cable according to claim 6, wherein the pressure-generating means is a pressure spring.

8. The electrical cable according to claim 3, wherein the housing is coated so as to be at least partly electrically insulating.

9. The electrical cable according to claim 3, wherein an insulating washer is arranged between the housing and the connection sections.

10. The electrical cable according to claim 1, wherein the faces of the connection sections of the cable are coated so as to be at least partly electrically insulating.

11. The electrical cable according to claim 1, further comprising at least one plastic encapsulation surrounding the at least one interruption region, wherein within the at least one plastic encapsulation there exists pressure.

12. The electrical cable according to claim 11, wherein the pressure within the at least one plastic encapsulation is thermally generated or reinforced pressure.

13. The electrical cable according to claim 11, wherein the at least one plastic encapsulation is formed by spraying around the connection sections.

14. The electrical cable according to claim 11, wherein the at least one plastic encapsulation is formed by pouring-in the connection sections.

15. The electrical cable according to claim 1, wherein the electrical cable is formed by screwing down the connection sections after pressure is applied.

16. The electrical cable according to claim 1, wherein the semiconductor element comprises a control electrode having an effective contact surface in contact with an electrical drive unit by a contact means arranged in the at least one interruption region.

17. The electrical cable according to claim 16, wherein the contact means is a spring contact pin (38) arranged concentric to the connection sections.

18. The electrical cable according to claim 16, wherein the contact means is a passive radio receiver.

19. The electrical cable according to claim 18, wherein the radio receiver comprises an aerial and a coil.

20. The electrical cable according to claim 19, wherein the radio receiver comprises a MOS structure.

21. The electrical cable according to claim 16, wherein the contact means is an optoelectric receiver.

22. The electrical cable according to claim 16, wherein the control electrode is arranged centered in relation to the contact surfaces of the semiconductor element effective for the current.

23. The electrical cable according to claim 22, wherein the control electrode is circular.

24. The electrical cable according to claim 22, wherein the control electrode comprises a polygon-shaped margin.

25. The electrical cable according to claim 16, wherein the contact means is a sound pickup.

26. The electrical cable according to claim 25, wherein the sound pickup comprises an aerial structure etched onto piezoelectric material.

27. The electrical cable according to claim 25, wherein the sound pickup comprises an interdigital filter.

28. The electrical cable according to claim 25, wherein the sound pickup operates in ultrasonic or range.

29. The electrical cable according to claim 25, wherein the sound pickup operates in hypersonic range.

* * * * *